US010980332B2

(12) United States Patent
Nakamura et al.

(10) Patent No.: US 10,980,332 B2
(45) Date of Patent: Apr. 20, 2021

(54) COSMETIC APPLICATOR

(71) Applicant: MITSUBISHI PENCIL COMPANY, LIMITED, Tokyo (JP)

(72) Inventors: Hitoshi Nakamura, Fujioka (JP); Seiichi Takigawa, Fujioka (JP); Takayuki Hayakawa, Fujioka (JP); Jun Nakada, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 133 days.

(21) Appl. No.: 16/364,481

(22) Filed: Mar. 26, 2019

(65) Prior Publication Data

US 2019/0298034 A1 Oct. 3, 2019

(30) Foreign Application Priority Data

Mar. 29, 2018 (JP) ..... JP2018-064857
Dec. 21, 2018 (JP) ..... JP2018-239607

(51) Int. Cl.
*A45D 34/04* (2006.01)

(52) U.S. Cl.
CPC ..... *A45D 34/042* (2013.01)

(58) Field of Classification Search
CPC .. A45D 34/042; A45D 34/041; A45D 40/205; A45D 2040/207; A45D 2040/208; A45D 40/261; A45D 40/262
See application file for complete search history.

(56) References Cited

U.S. PATENT DOCUMENTS 4,917,522 A * 4/1990 Kay ..... A45D 34/042 222/562
5,230,577 A * 7/1993 Cox ..... A45D 40/04 401/50
5,749,665 A * 5/1998 Kato ..... A45D 34/042 401/264
5,879,095 A * 3/1999 Gueret ..... A45D 34/042 401/172
6,186,686 B1 * 2/2001 Neuner ..... A45D 34/04 401/132

(Continued)

FOREIGN PATENT DOCUMENTS

JP 60-116495 A 6/1985
JP 9-118095 A 5/1997

(Continued)

*Primary Examiner* — Nicholas D Lucchesi
(74) *Attorney, Agent, or Firm* — Westerman, Hattori, Daniels & Adrian, LLP

(57) ABSTRACT

Provided is a cosmetic applicator having an applying part at the tip end and a container containing liquid cosmetic to be applied through the applying part. A tip-most portion of the applying part is disposed at a position deviated from an axis of the applying part and an angle θ between a line perpendicular to the axis and a side ridge line at applying part end ranges from 10° to 60°, a circular flange is formed at a rear end of the applying part, a projecting length of the applying part from a front barrel ranges from 5 to 8 mm, a ratio of a major and minor axis Y, X of an opening is Y:X=1.3 to 2:1, and when A and B respectively denote an applied area at deformation load of 0.01 N and that at 0.1 N, A<B<3A is satisfied.

5 Claims, 15 Drawing Sheets

(56) References Cited

U.S. PATENT DOCUMENTS

| | | | | |
|---|---|---|---|---|
| 6,601,631 | B1 * | 8/2003 | Miller | B65H 37/007 118/76 |
| 2005/0169695 | A1 * | 8/2005 | Noguchi | A46B 11/0027 401/277 |
| 2007/0020027 | A1 * | 1/2007 | Gueret | A45D 40/262 401/130 |
| 2007/0251541 | A1 * | 11/2007 | Nasu | B65D 83/0011 132/320 |
| 2009/0038545 | A1 * | 2/2009 | Akaishi | A61M 35/003 118/300 |
| 2009/0116895 | A1 * | 5/2009 | Uehara | A45D 34/042 401/269 |
| 2009/0283033 | A1 * | 11/2009 | Akaishi | B05C 17/00516 118/410 |
| 2012/0328354 | A1 * | 12/2012 | Koyama | B43L 19/0068 401/179 |
| 2013/0056020 | A1 * | 3/2013 | Wilson | B05C 17/00 132/320 |
| 2013/0134189 | A1 * | 5/2013 | Kageyama | A45D 34/00 222/391 |
| 2013/0315645 | A1 * | 11/2013 | Gutberlet | A45D 33/36 401/81 |
| 2015/0016857 | A1 * | 1/2015 | Sato | A61K 8/73 401/16 |
| 2019/0307228 | A1 * | 10/2019 | Baumann | A45D 34/042 |
| 2020/0130403 | A1 * | 4/2020 | Maruyama | B05C 17/00 |

FOREIGN PATENT DOCUMENTS

| | | | |
|---|---|---|---|
| JP | 2002-68332 | A | 3/2002 |
| JP | 2011-72488 | A | 4/2011 |

* cited by examiner

COSMETIC APPLICATOR

BACKGROUND OF THE INVENTION

Field of the Invention

The present invention relates to a cosmetic applicator, and for example, to a cosmetic applicator using a brush head formed by synthetic resin fibers in an applicator such as an eyeliner or an eyebrow liner.

Description of the Related Art

A knock type delivery container has been employed in a cosmetic applicator. This conventional knock type delivery container uses a cam mechanism similar to that of ballpoint pens, including a knocking body, a rotor, and an inner sleeve, each having a cam, so that the rotor being urged rearwards by a spring is continuously rotated by knocking, whereby the rotation of the rotor is transmitted to a threaded rod provided with a threaded part, which is a male thread, at an outer periphery thereof. Since this threaded rod is screw-fitted with a threaded part, which is a female thread, provided at an inner bore part of a threaded body that is fixed to a barrel body at least with respect to a rotational direction, a knock type delivery container in which the threaded rod advances with respect to the threaded body as the threaded rod rotates so as to dispense the content, which is called a Khan knock type, is known, for example, in references of JP 60-116495 A, JP 9-118095 A, and JP 2002-068332 A.

However, among the above-described knock type delivery containers, in a container with a mechanism in which the threaded rod is advanced, the rotational force of the rotor is determined by the cam shape and the strength of the spring. Hence, in a case where the viscosity of the liquid cosmetic as the content is high, or in a case where phenomenon of a piston sticking to the barrel body due to passage of time, it is considered that a rotational movement becomes impossible. Further, the number of components increases and there might be restrictions on the external appearance such as thinning of a diameter.

The present applicant has proposed, contrary to this, in JP 2011-72488 A, a knock type delivery container in which a rotary body including a first cam face and a second cam face having serrated cam teeth formed with an identical pitch is rotated by repeatedly applying and releasing pressure by a first fixed cam and a second fixed cam having serrated cam teeth formed with an identical pitch, and the rotational force is transferred to a threaded rod to advance a piston. According to this knock type delivery container, it is possible to achieve prevention against rotational movement failure due to sticking of the piston, and a reduction of components in number.

In an embodiment of the knock type delivery container disclosed in JP 2011-72488 A by the present applicant, a brush head formed by bundling a large number of fibers and being in the form of a conical tip having a pointed tip end is described as an example of a tip end applicator.

As described in JP 2011-72488 A, as a conventional brush head for applying a liquid cosmetic such as an eyeliner or an eyebrow liner, a brush head in the form of a conical tip having a pointed tip end is generally used.

However, in a case where a fluid such as a liquid cosmetic is supplied to a brush head simply formed in a conical tip shape and the fluid is applied by the brush head, for example, in cosmetic application to eyebrows or eyes, since the brush tip is sharply pointed, a problem arises in that drawing difference in line thickness is not easy.

Further, in the case of recoating, a problem arises in that scrubbing a previously-coated layer with the conical tip is likely apt to generate dregs.

SUMMARY OF THE INVENTION

The present invention was made by focusing on the above-described points, and an object of the invention is to provide a cosmetic applicator including a knock type delivery container, for example, which applicator includes a brush head enabling to draw difference in line thickness and preventing dregs generating at the time of recoating. In order to solve the above-described problems, a cosmetic applicator according to the present invention includes an applying part at a tip end, a containing part, and a liquid cosmetic contained in the containing part, the liquid cosmetic being applied through the applying part, wherein a tip-most portion of the applying part is disposed at a position deviated from an axis of the applying part, an angle θ formed between a line perpendicular to the axis and a side ridge line, which is a longest edge line appearing when viewed from a side of the applying part, of the applying part ranges from 10° to 60°, a circular flange is formed at a rear end of the applying part, a projecting length of the applying part from a tip end of a front barrel ranges from 5 to 8 mm, a ratio of a major axis Y and a minor axis X of an opening, being located at the tip end of the front barrel in the applying part, is Y:X=1.3 to 2:1, and when an applied area at a deformation load of 0.01 N and an applied area at a deformation load of 0.1 N both measured from the tip-most portion of the applying part are respectively designated as A and B, $A<B<3A$ is satisfied.

With such a configuration of the present invention, a tip-most portion of the applying part formed by bundling a large number of fine fibers is formed such that an angle θ formed between a line perpendicular to the axis and a side ridge line of the applying part ranges from 10° to 60°, a circular flange is formed at a rear end of the applying part, a projecting length of the applying part from the part tip end of the front barrel ranges from 5 to 8 mm, a ratio of the major axis Y to the minor axis X of the opening, being located at the tip-most end of the front barrel in the applying part, Y:X=1.3 to 2:1, and when the applied area at a deformation load of 0.01 N and the applied area at a deformation load of 0.1 N both measured from the tip-most portion of the applicator part are respectively designated as A and B, $A<B<3A$ is satisfied. As a result, it is possible to facilitate application of a liquid cosmetic, specifically, line drawing with an eyeliner or an eyebrow liner, drawing difference in line thickness, and the like.

Herein, it is desirable that the applying part is formed of a fiber bundle obtained by bundling a plurality of fibers, and a tip end of each fiber has a curvature.

The tip end part of the fiber having a curvature means that there is no sharp part, and as a result, soft feeling in application can be obtained.

Further, it is desirable that the applying part is formed of a fiber bundle obtained by bundling a plurality of fibers, and a variation in length in tip end of each fiber with respect to the side ridge line of the applying part is within a range of 1 mm.

As described above, because the variation in length in the tip end of each fiber is within a range of 1 mm, and the side ridge line of the applying part becomes linear, width of drawn lines can be easily adjustable by varying pressing force as desired when the applicator is used; this is preferable.

Moreover, it is desirable that the applying part is formed of a fiber bundle obtained by bundling a plurality of fibers with a small outer diameter and a plurality of fibers with a large outer diameter, and the fibers with small outer diameter are mixed more than the fibers with large outer diameter.

As described above, by mixing the fibers with small outer diameter more than the fibers with large outer diameter in the applying part, suitable flexibility can be obtained, and occurrence of dregs at the time of recoating and the like can be prevented.

Furthermore, it is desirable that a viscosity of the liquid cosmetic is within a range of 1.5 mPa·s to 70 mPa·s.

According to the present invention, it is possible to provide a cosmetic applicator including a knock type delivery container which applicator includes a brush head enabling to draw different thicknesses and preventing dregs generating at the time of recoating.

DESCRIPTION OF THE PREFERRED EMBODIMENTS

Figure 1:
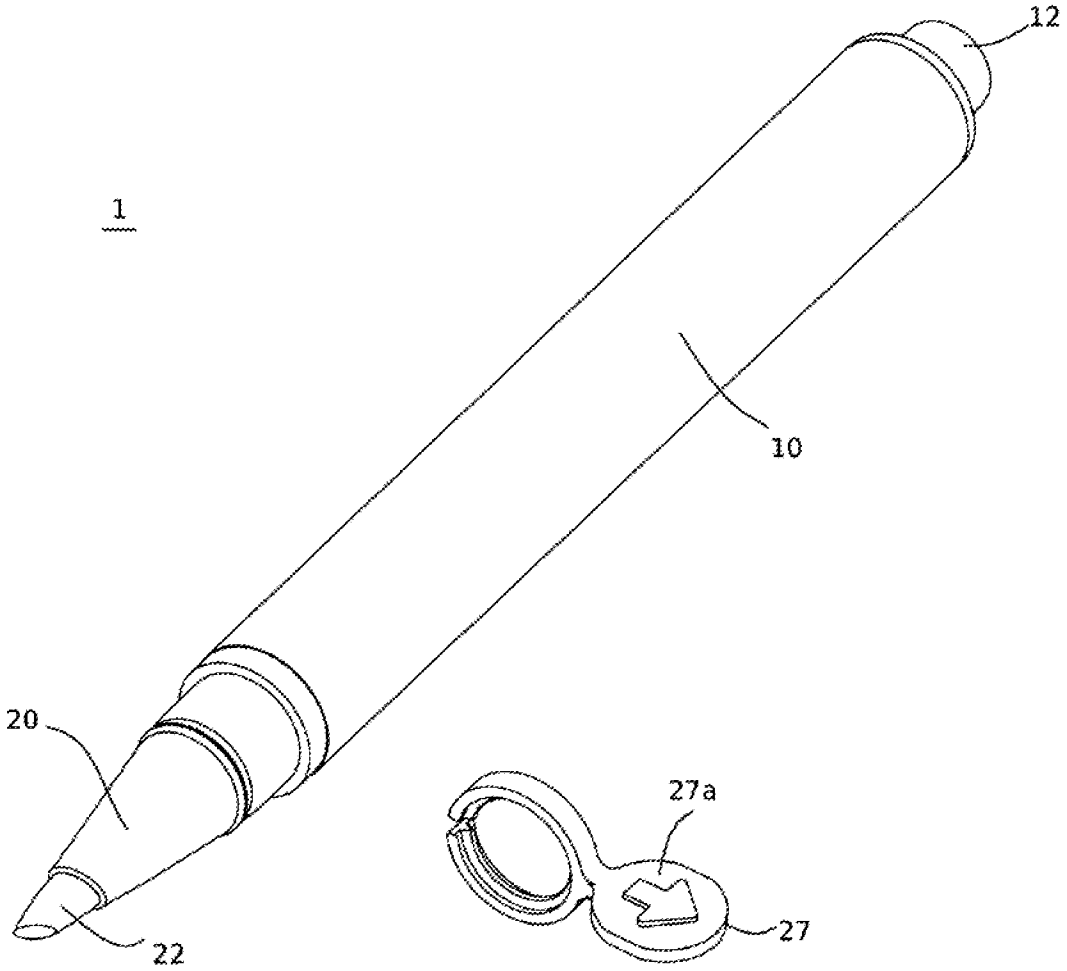
FIG. 1 is a perspective view of a cosmetic applicator according to the present invention where a cap is removed.
Figure 2A:
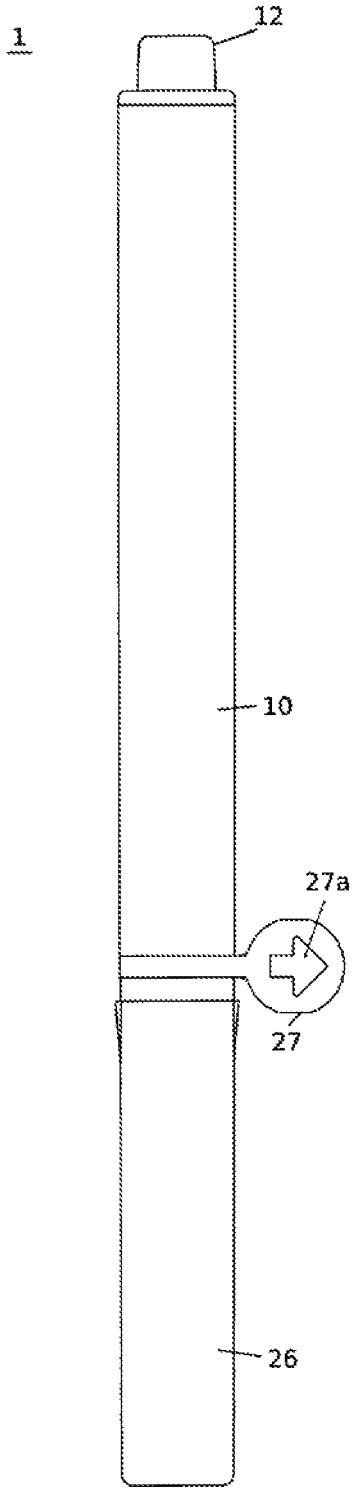
FIG. 2A is a front view of the cosmetic applicator of FIG. 1 to which the cap is attached.
Figure 2B:
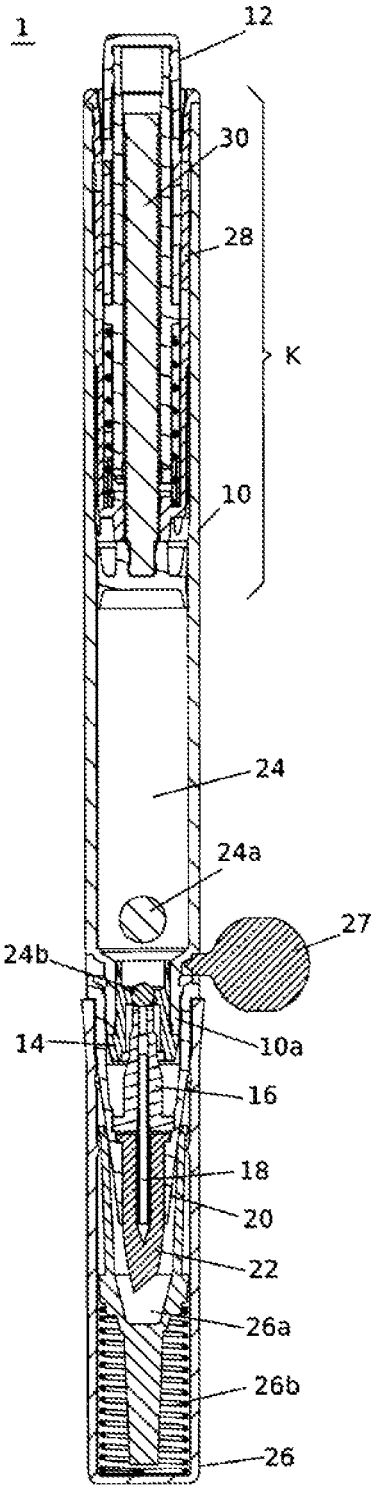
FIG. 2B is a cross-sectional view of the cosmetic applicator shown in FIG. 2A.
Figure 3:
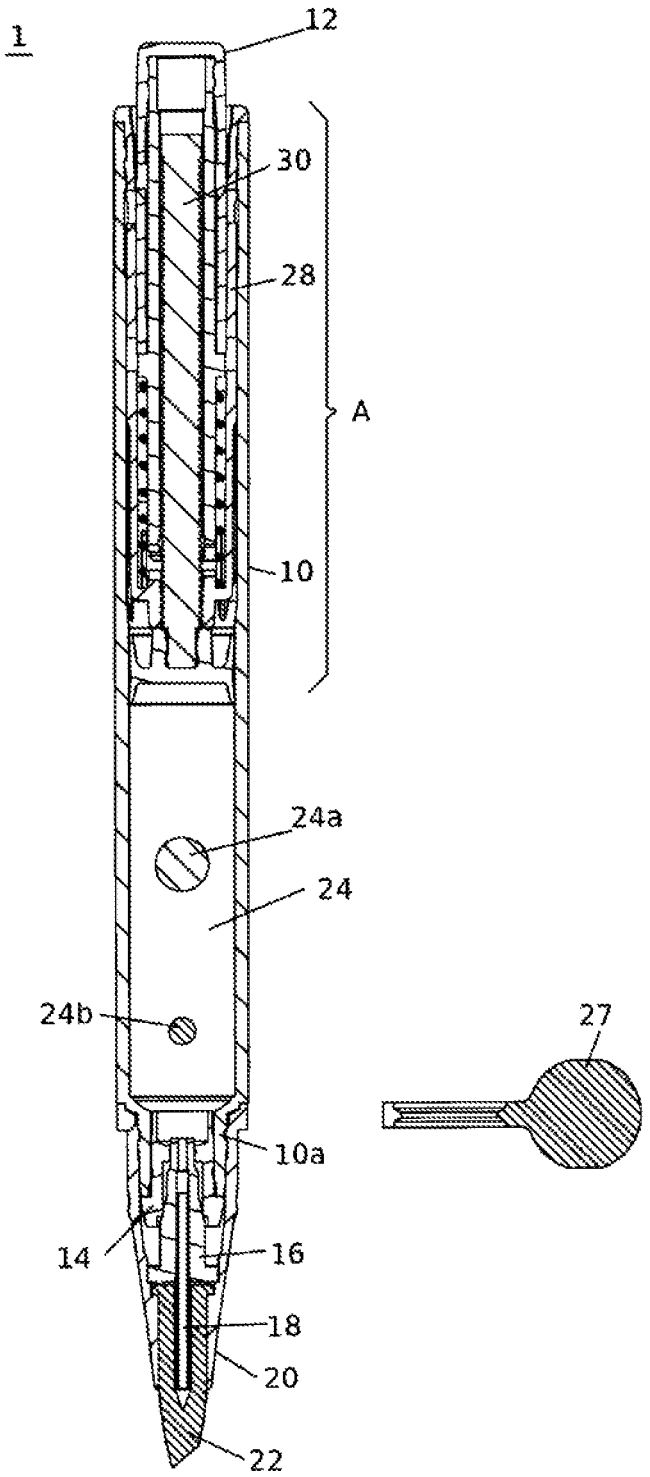
FIG. 3 is a cross-sectional view of the cosmetic applicator in which a stopper is removed from the state of FIG. 2B.

An embodiment of a cosmetic applicator according to the present invention will be described on the basis of drawings. FIG. 1 is a perspective view of a cosmetic applicator according to the present invention where a cap is removed. FIG. 2A is a front view of the cosmetic applicator of FIG. 1 where the cap is put on, and FIG. 2B is a cross-sectional view of the cosmetic applicator illustrated in FIG. 2A. Further, FIG. 3 is a cross-sectional view of the cosmetic applicator shown in FIG. 2B where a stopper is removed. As illustrated in FIG. 2B, a cosmetic applicator 1 is a delivery container that can deliver the contents, that is, a liquid cosmetic, contained in a container 24 by pressing a crown 12 forwards in an axial direction, disposed at a rear end part of a barrel body 10. More specifically, the cosmetic applicator 1 has a knocking mechanical assembly K that transforms the pressing force acting on the crown 12 by a knocking operation of a user into the rotational force, a threaded body 28 fixed to the barrel body 10, and a threaded rod 30 screw-fitted into the threaded body 28, and delivers the contents by advancing the threaded rod 30 through the threaded body 28 when the threaded rod 30 is rotated by the rotational force converted by the knocking mechanical assembly K.

In the cosmetic applicator 1, a joint 14, a pipe joint 16, a pipe 18, a front barrel 20, and a brush head 22 are attached to a front end part 10*a* of the barrel body 10, and the contents dispensed from the container 24 for the contents, which is a liquid cosmetic, in the barrel body 10 passes through the pipe 18 to be ejected to the brush head 22. Further, this cosmetic applicator is formed such that a cap 26 can be fitted after use.

A symbol 24*a* designates an agitating ball that agitates the contents in the container 24 by reciprocating operation, a symbol 26*a* designates an inner cap, a symbol 26*b* designates a spring for urging the rear of the inner cap, and a symbol 27 is a stopper for confining the passage of the contents to the pipe 18 and its downstream when not in use. At the rear end part of the pipe 18, a seal ball 24*b* contacts closely to an inner bore part of the joint 14 so that the contents will not flow into the pipe 18 when not in use. Meanwhile, when in use, the stopper 27 is pulled out from the barrel body 10, and the front barrel 20 is pushed in toward the rear end so that the seal ball 24*b* is removed from the inner bore part of the joint 14, whereby the contents flow into the pipe 18 and can be applied.

Figure 7A:
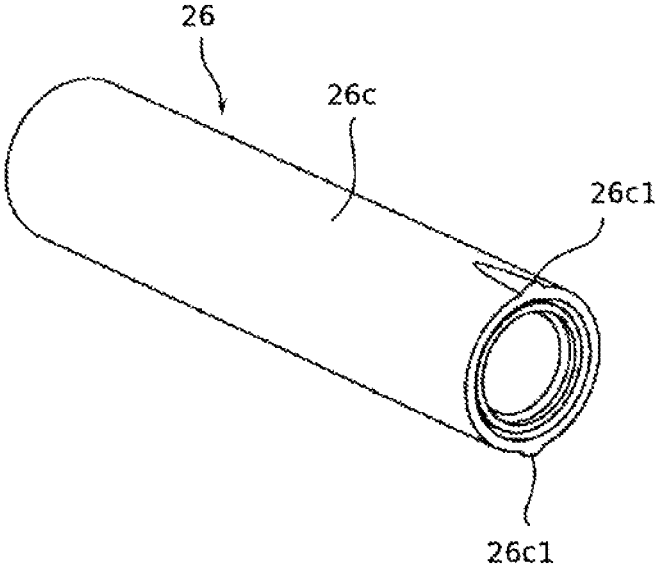
FIG. 7A is a perspective view of the cap of the cosmetic applicator according to the present invention.

In the cap 26, as illustrated in the perspective view of FIG. 7A, a projection 26*c*1 to prevent rolling when not used is formed on the outer surface of a tubular outer cap 26*c*. The projection 26*c*1 is 3 to 10 mm in length from an opening end, 1 to 3 mm in width, and 0.3 to 1 mm in height to achieve both of rolling prevention function and design property. Further, the projection 26*c*1 is formed at two places with equal intervals in the embodiment, as illustrated in FIG. 7A, but may be formed at least one or more places.

Figure 7B:
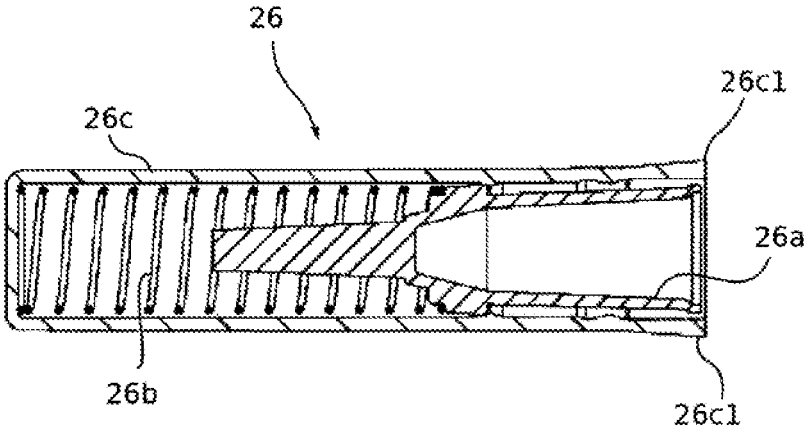
FIG. 7B is a cross-sectional view of the cap of the cosmetic applicator.

Further, as illustrated in the cross-sectional view of FIG. 7B, inside the cap 26, that is, actually inside the outer cap 26*c*, provided are a spring 26*b* and an inner cap 26*a* fitted into the cap 26 with receiving an urging force from the spring 26*b*.

Figure 8A:
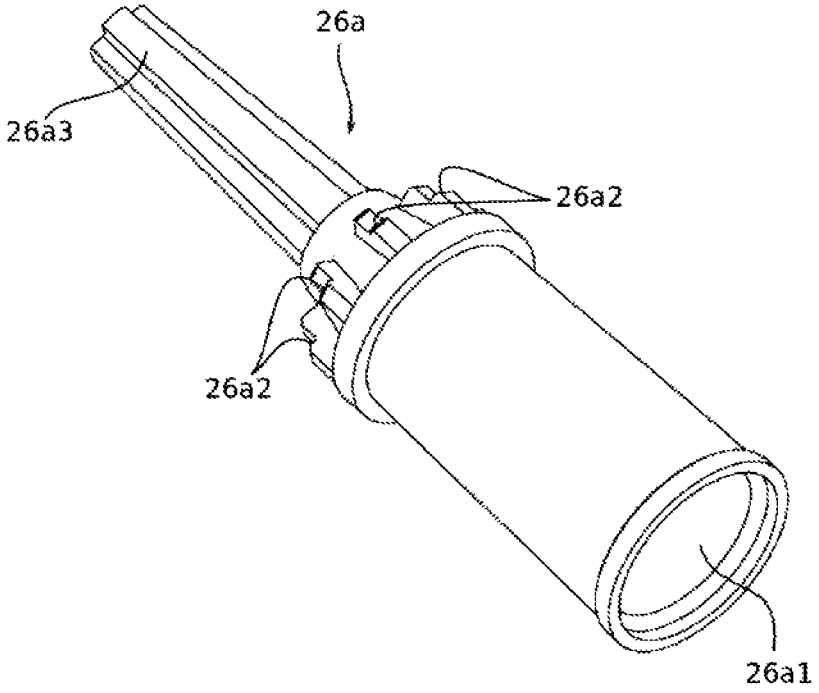
FIG. 8A is a perspective view of an inner cap accommodated in the cap shown in FIGS. 7A and 7B seen from the rear side.
Figure 8B:
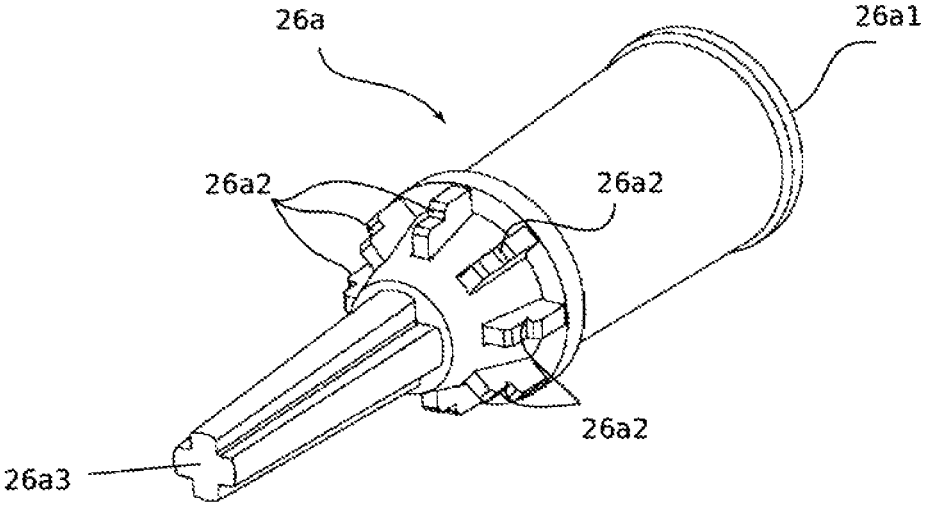
FIG. 8B is a perspective view of the inner cap seen from the front side.

The inner cap 26*a* includes, as illustrated in FIGS. 8A and 8B, a housing part 26*a*1 where the brush head is housed when not used, spring resting surfaces 26*a*2 of the spring 26*b* for urging the rear of the inner cap, and a pillar 26*a*3 having a cross-section of a cross shape. By providing the pillar 26*a*3, an effect of preventing sticking to the outer cap 26*c* when the inner cap 26*a* is pushed forward too far is obtained. The cross-section of the pillar 26*a*3 may be a circle, a square, or the like, but in order to prevent buckling caused by contact with the outer cap 26*c*, the cross-section of the pillar 26*a*3 is preferably formed in a cross shape as illustrated in the drawings.

Figure 5:
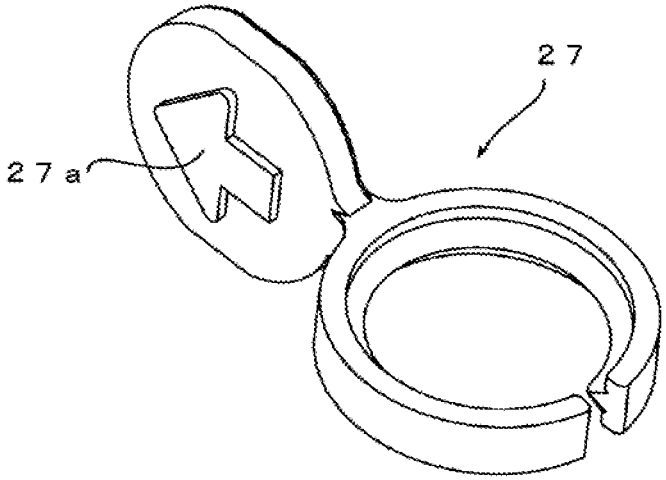
FIG. 5 is a perspective view of the stopper.

As illustrated in FIGS. 1 and 5, in the stopper 27, a knob portion 27*a* is formed large in size and an arrow is marked on the knob portion 27*a*. This arrow is provided to visually and clearly show a correct pulling-out direction. That is, a user can pull the stopper 27 in the arrow direction and pulling out the stopper 27 correctly from the barrel body 10, the user can use the applicator without failure.

Figure 9A:
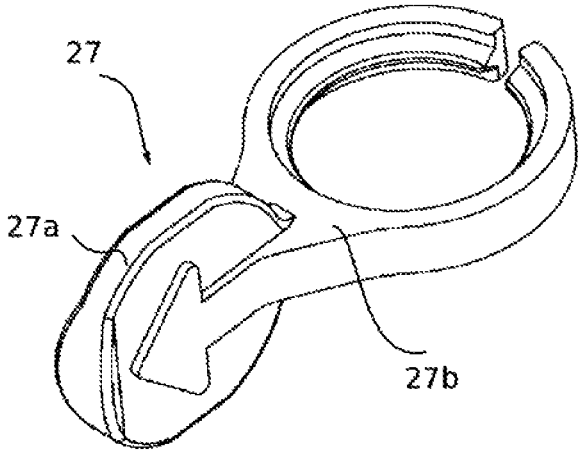
FIG. 9A is a perspective view of another exemplary stopper different from that of FIG. 5.
Figure 9B:
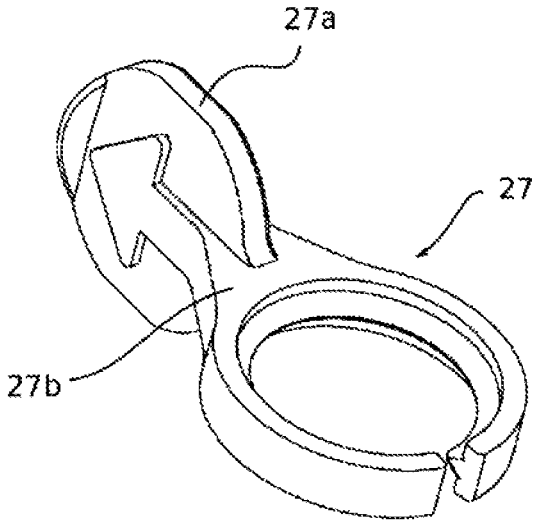
FIG. 9B is a perspective view of the stopper illustrated in FIG. 9A as seen from a different direction.

Further, as other examples of stopper 27 shown in FIGS. 9A and 9B, forming a thickened part 27*b* enables breaking of the tab 27*a* by twisting to be prevented, when being pulled out.

Figure 4:
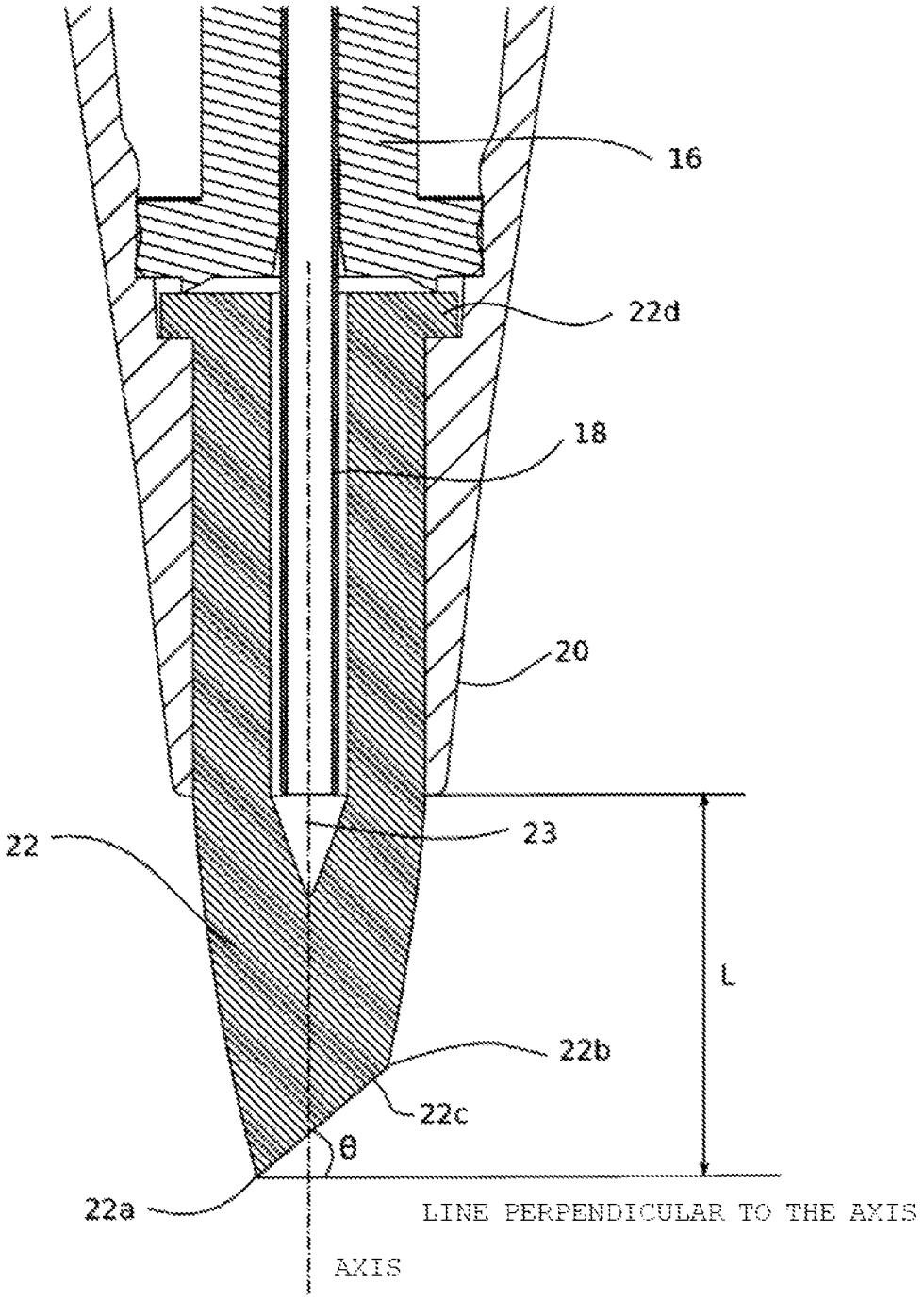
FIG. 4 is a side view illustrating an enlarged brush head to be an applicator part.
Figure 6A:
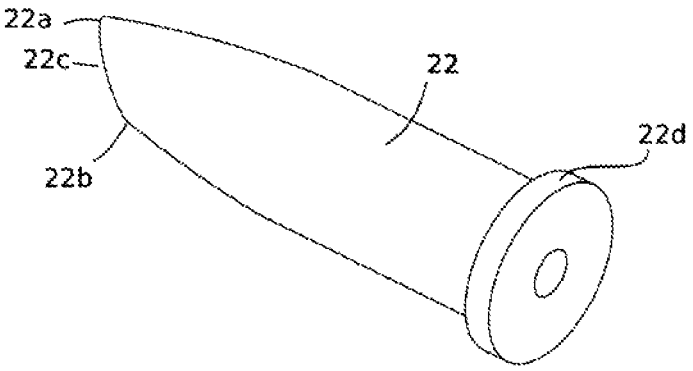
FIG. 6A is a perspective view of a brush head seen from a rear side thereof.
Figure 6B:
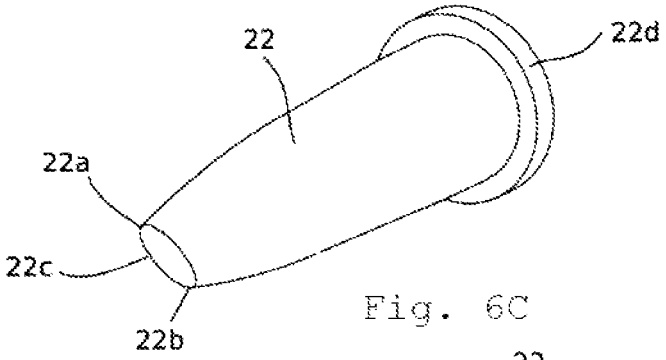
FIG. 6B is a perspective view of the brush head seen from a tip end side thereof.
Figure 6C:
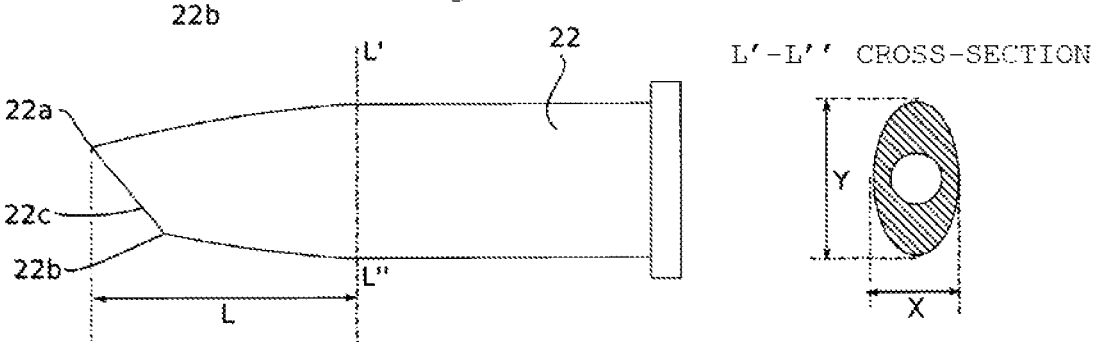
FIG. 6C is a side view of the brush head.
Figure 6D:
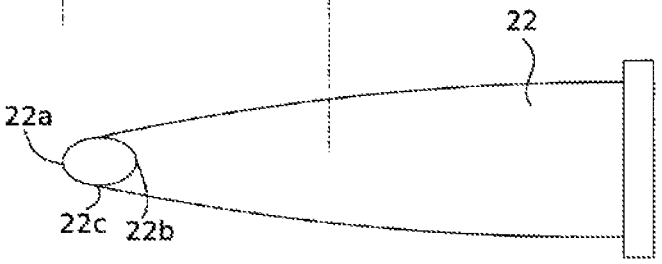
FIG. 6D is a plan view of the brush head.

Further, FIG. 4 is a side view illustrating an enlarged brush head to be an applying part, and FIGS. 6A to 6D are enlarged view of the brush head 22 as an applying part. FIG. 6A is a perspective view of the brush head 22 seen from the rear side thereof, FIG. 6B is a perspective view of the brush head 22 seen from the tip end side thereof, FIG. 6C is a side view of the brush head 22, and FIG. 6D is a plan view of the brush head 22.

The brush head 22 illustrated in those drawings is formed of a fiber bundle that is obtained by integrally bundling one end of synthetic resin fibers having a predetermined length, and the synthetic resin fibers are formed in a tapered shape the diameter of which gradually decreases as going to the brush head tip end. More specifically, synthetic resin fibers to be used are formed into a fiber bundle by combining fibers each having a different outer diameter, where 60% of fibers having an outer diameter of 0.10 mm and 40% of those having an outer diameter of 0.15 mm, for example; the fiber bundle is cut to have a shape as shown in FIGS. 4 and 6A to 6D.

A top-most portion 22*a* of the brush head 22 is disposed at a position deviated from an axis 23 of the brush head 22, and a beveled edge 22*b* positioned at the opposite side to the top-most portion 22*a* with the axis 23 interposed therebetween and a side ridge line 22*c* connecting the beveled edge 22*b* and the top-most portion 22*a* are included.

The side ridge line 22*c* is formed such that the angle θ formed between the line perpendicular to the axis 23 of the brush head 22 and the side ridge line of the applying part ranges 10° to 60°, more preferably 30° to 50°, and a circular flange 22*d* is formed by thermal fusion bonding at the rear end of the applicator part, which flange is to be attached to a front barrel 20. Further, from the viewpoint of stability against the thermal fusion bonding and ease of drawing in different thickness and recoating, the number of the synthetic resin fibers is preferably set to 300 to 1500.

Further, as illustrated in FIG. 4, a projecting length L from the tip end of the barrel of the applying part is formed to range from 5 to 8 mm. Further, as illustrated in FIG. 6C, a ratio of the major axis Y to the minor axis X of the front barrel opening of the applying part, Y:X, is set to be 1.3 to 2:1.

Furthermore, when an applied area at a deformation load of 0.01 N and an applied area at a deformation load of 0.1 N measured from the tip-most portion of the applying part are respectively designated as A and B, a relation A<B<3A is satisfied.

Figure 11A:
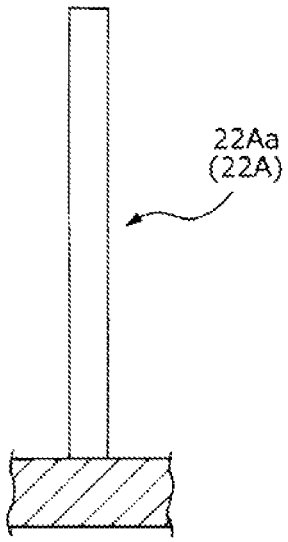
FIG. 11A is a view illustrating an example of fibers constituting the applicator part, which is a side view illustrating cylindrical straight fibers.
Figure 11B:
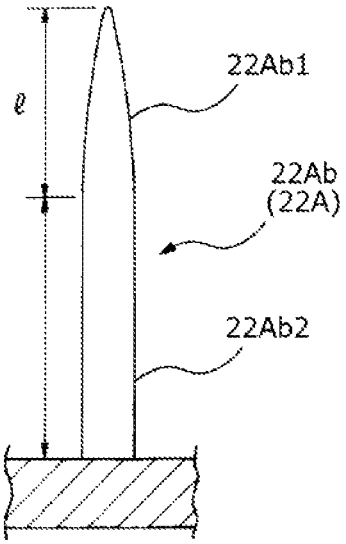
FIG. 11B is a view illustrating an example of fibers constituting the applicator part, which is a side view illustrating tapered fibers.

As synthetic resin fibers 22A forming the brush head 22, columnar straight fibers 22Aa as illustrated in FIG. 11A can be used. Further, as illustrated in FIG. 11B, tapered fibers 22Ab can be used whose diameter gradually decrease as approaching the tip end and which have a tapered surface 22Ab1 formed at the tip end part. A length l of the tapered surface 22Ab1 of the tapered fibers 22Ab is formed in a range of 0.5 to 15 mm from the tip end of the synthetic resin fibers.

Furthermore, the columnar straight fibers 22Aa illustrated in FIG. 11A and the tapered fibers 22Ab illustrated in FIG. 11B may be used mixedly.

A tapering process for obtaining the tapered fibers 22Ab is specifically performed with respect to the synthetic resin fibers using a soluble or swellable processing solution while the synthetic resin fibers are swollen and polishing/rubbing is performed.

A fiber bundle of the tapered fibers 22Ab thus obtained or a fiber bundle obtained by mixing the tapered fibers 22Ab with the straight fibers 22Aa is obliquely aligned such that the angle θ formed between the line perpendicular to the axis 23 of the brush head 22 and the side ridge line of the applying part is set to be 10° to 60°, and then one end part of the synthetic resin fibers is integrally bundled, that is, the flange 22*d* is formed, so that the fiber bundle may be formed.

As described above, by using the fiber bundle including the tapered fibers 22Ab, the stiffness, bending strength, of the fiber bundle body can be increased more at the lower side thereof, and usability can be improved.

For example, when mascara is applied, the tip end part of the tapered fibers 22Ab are made easily enter a space between eyelashes. Further, since the stiffness, bending strength, can be increased more at the lower side from the tapered surface 22Ab1 to straight body part 22Ab2, fibers easily enter each eyelash without being overwhelmed by the stiffness of the eyelashes, the liquid can be neatly applied to each eyelash, and both eyelashes can also be curled by pushing up the upper eyelash and pushing down the lower eyelash after application. Furthermore, since the tip end of the tapered fibers is thin, favorable skin touch with respect to the root of the eyelash and the skin can be achieved, and additionally suppress the liquid being applied too much.

In particular, since the tapered fibers 22Ab are formed by polishing/rubbing using a soluble or swellable processing solution while the synthetic resin fibers are swollen, the tip end part of the tapered fibers 22Ab have a curved surface or curvature. Since there is no sharp part because of formation of the curved surface or curvature, soft touch feeling can be obtained.

As described above, when the tapered fibers 22Ab are formed, the curved surface or curvature is formed in the tip end part, but without forming the tapered surface 22Ab1, fibers may be immersed in the soluble or swellable processing solution to form only the curved surface or curvature in the tip end part.

Herein, fibers having the curved surface or curvature at the tip end part mean fibers having no processed sharp part at the tip end part.

Further, a dry weight of the brush head 22 without containing the application liquid is desirably set to be from 0.03 g to 0.1 g. Moreover, as illustrated in FIGS. 4 and 6C, the ratio of the major axis Y to the minor axis X in the cross-section at the rear side distant from the tip end of the brush head 22 by the projecting length L, that is, at the front barrel opening of the applying part, is desirably set to be 1.3 to 2:1 and a tip end area S is desirably set to be from 2 $mm^2$ to 4 $mm^2$. When the tip end area S is set to be from 2 $mm^2$ to 4 $mm^2$, a contact area A can be set to be 2 $mm^2$ to 4 $mm^2$ when a load of 0.01 N is applied to the brush head 22; this means that the tip end area S and the contact area A when a load of 0.01 N is applied to the brush head 22 can be regarded to be approximately equivalent.

As a result, the brush tip is not contacted and drawing the difference in line thickness can be facilitated.

Further, it is desirable that the brush head 22 is formed of a fiber bundle obtained by bundling a plurality of fibers having a small outer diameter and fibers having a large outer diameter, and the fibers having a small outer diameter are mixed more than the fibers with a large outer diameter.

For example, by mixing fibers having a diameter of 0.10 mm contained in 60% to 95% with fibers having a diameter of 0.15 mm contained in 5% to 40%, flexibility is imparted to the brush head 22; occurrence of dregs can be prevented when repeatedly coated.

Figure 12:
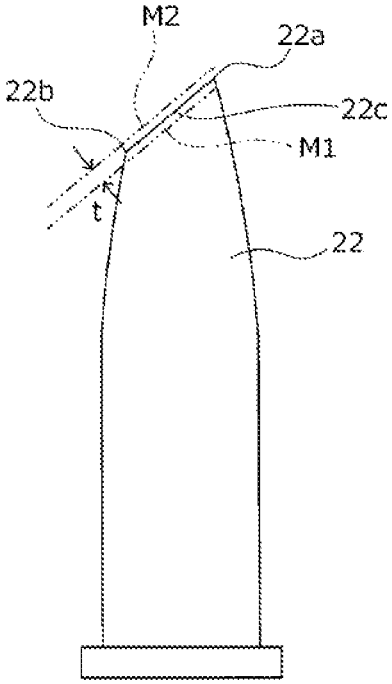
FIG. 12 is a view illustrating a variation in fibers with respect to a side ridge line of the applicator part.

Further, as illustrated in FIG. 12, it is desirable that, with respect to the side ridge line 22*c* of the brush head 22, variation range t in length at the tip-end of each of the fibers is 1 mm, where each fiber has the shortest length M1 to the tip-end or the longest length M2 to the tip-end as shown in the drawing.

As described above, when the variation in tip end of each fiber is set within a range of 1 mm, the side ridge line of the brush head 22 becomes linear; and thus it is desirable that a line width is easily and optionally adjustable by changing the magnitude of the force when in use. Further, the brush head 22 can be provided with an antimicrobial agent. The antimicrobial agent can be formed in such a manner that the antimicrobial agent is coated to the surface the brush head 22 or kneaded in synthetic resin fibers. Specifically, antimicrobial examples include benzoic acid and salts thereof, salicylic acid and salts thereof, sorbic acid and salts thereof, dehydroacetic acid and salts thereof, p-hydroxybenzoic acid ester and a sodium salt thereof, phenoxyethanol, trichlorohydroxydiphenyl ether, sodium lauryldiaminoethylglycinate, resorcin, isopropyl methylphenol, alkyldiaminoethylglycine hydrochloride, cetylpyridinium chloride, benzalkonium chloride, benzethonium chloride, orthophenylphenol, sodium orthophenylphenol, chlorhexidine gluconate, cresol, chloramine-T, chloroxylenol, chlorphenesin, chlorhexidine and salts thereof, alkylisoquinolinium bromide, thymol, hinokitiol, pyrithione zinc, polyaminopropyl biguanide, methylisothiazolinone, iodopropynyl butylcarbamate, Kankoh-so (bioactive dyes), isopropyl methylphenol, ethylhexylglycerin, alkane diol such as pentanediol, hexanediol, or octanediol, silver-containing glass particles, and zinc-containing glass particles. Preferably, those which have a low solubility to the liquid cosmetic, saliva, or the like and are solid at normal temperature are selected.

When the solubility to the liquid cosmetic, saliva, or the like is low, those materials can be dissolved little by little into objects so that the effect according to the present invention can be maintained for a long period of time. Further, when those materials are solid at normal temperature, a coating film or an antimicrobial layer can be maintained over a long period of time. Surprisingly, the antimicrobial agent which is solid at normal temperature has an excellent adhesion property to filaments, that is, fibers composing the brush head, and also has an excellent adhesiveness in that the antimicrobial agent will not drop off with being attached to the filaments even when the filaments are bent. As such antimicrobial agents, particularly, p-hydroxybenzoic acid ester and a sodium salt thereof, chlorhexidine, silver-containing glass particles, and zinc-containing glass particles can be exemplified.

The antimicrobial agents are diluted with an organic solvent or the like, the filaments or the brush head can be coated with the antimicrobial agents by immersing in the diluted solution. The higher the concentration of the antimicrobial agent becomes, the thicker coatings are formed on the filaments without cracks and slits. In case of parabens, however, which is solid at normal temperature, when the concentration of the dilution becomes more than 10 wt %, the coated antimicrobial agent are subject to drop off by a slight force, an expected antimicrobial effects are not obtained. Instead, a dilution with a concentration of about 5% by weight results in favorable effects. Needless to say, when the concentration is too low, for example, 0.01% by weight or less, coating on the filament surface is not satisfactory, and also in this case, an expected antimicrobial effect is not obtainable.

The contents is a liquid cosmetic containing 0.001 wt % to 30.0 wt % of at least a dye or an inorganic pigment with respect to the entire liquid cosmetic, a dispersant, 5 wt % to 35 wt % of a coating film forming agent with respect to the entire liquid cosmetic in terms of solid content, an antiseptic agent, alkane diol, and water. Further, the coating film forming agent is an emulsion of a homopolymer or copolymer containing as a raw material monomer one or two or more compounds selected from acrylic acid, methacrylic acid, or (C1 to C4 and C8) alkyl esters of those, or styrene.

Further, as the inorganic pigment, carbon black, an iron oxide pigment such as Bengal red, black iron oxide, or yellow iron oxide, and a pigment such as ultramarine, titanium black, Prussian blue, or titanium oxide can be suitably used. Preferably, it is desirable to use carbon black and/or an iron oxide pigment. Further, in the case of using an iron oxide pigment, from the viewpoint of temporal stability, it is desirable that an average diameter of the particles is preferably 100 nm or less and, more preferably, 30 nm to 100 nm.

This "average particle diameter" is a value obtained with a particle diameter measuring instrument FPAR-1000 utilizing a dynamic light scattering method, which is manufactured by Otsuka Electronics Co., Ltd. It is desirable that a content of those inorganic pigments is set to preferably be 0.001 wt % to 30.0 wt % and more preferably 0.001 wt % to 20.0 wt % with respect to the entire liquid cosmetic, which is the total amount of the liquid cosmetic. When the content of the inorganic pigments is less than 0.001 wt %, a coloring power becomes weaker; on the other hand, when the content thereof is more than 30.0 wt %, natural finish is not obtained; it is not preferable.

Furthermore, from the viewpoint of liquid amount adjustment at the time of make-up and stability of a cosmetic material, the viscosity at a temperature of 25° C. and at a shear rate of 38.3 $s^{-1}$ measured using a cone-plate viscometer is desirably set to be in a range of 1.5 mPa·s to 70 mPa·s, and particularly preferably, in a range of 1.8 mPa·s to 40 mPa·s. When the viscosity value is set to be 1.5 mPa·s or more, coating properties are excellent and the effect according to the present invention can be further achieved. When the viscosity value is set to be 70 mPa·s or less, liquid is smoothly ejected in the case of using a liquid cosmetic applicator, which uses a brush tip or a pen lead as an application means for the liquid cosmetic. The viscosity measurement condition, which includes Examples described later, specifically means a value measured at a temperature of 25° C. and at a shear rate of 38.3 $s^{-1}$ and at 10 rpm of a standard cone rotor of a cone-plate viscometer manufactured by Tokimec, Inc.

With such a liquid cosmetic, a cosmetic for eyeliner or eyebrow can be provided, having characteristics of no color separation over time, excellent temporal stability, and long-lasting make-up.

When a user uses the cosmetic applicator 1 having such a configuration for the first time from an unused state, the user pulls the stopper 27 toward the arrow direction described on the stopper 27 and removes the stopper 27 from the barrel body 10.

Then, when the user pushes the front barrel 20 in toward the rear end, the seal ball 24*b* is detached from the inner bore part of the joint 14, and the liquid cosmetic as the contents can flow into the pipe 18 so that the liquid cosmetic can be applied.

At the time of application, the tip end cutting angle θ of the brush head 22 ranges from 10° to 60°, the projecting length of the applying part from the tip end of the front barrel ranges 5 to 8 mm, and the ratio of the major axis Y to the minor axis X of the tip opening of the front barrel, Y:X, is 1.3 to 2:1. Further, since A<B<3A is satisfied, where an applied area at a deformation load of 0.01 N and an applied area of a deformation load of 0.1 N both measured from the tip-most portion of the applying part are respectively designated as A and B, for example; in the case of drawing an eyebrow, an eyebrow liner is easily positioned to the eyebrow and drawing can be performed with checking an oblique line visually. Further, effects of easy usage can be obtained due to clearness of a difference between a thick line and a thin line.

Further, the brush head 22 is formed by combining fine fibers each having a different outer diameter so that suitable flexibility can be obtained. In the case of recoating, it is possible to eliminate a trouble that the brush head scratches the previous coating film and dregs occurs.

Further, when the viscosity of the liquid cosmetic is set to be 1.5 mPa·s to 70 mPa·s and an applied amount is set to be 1 mg to 5 mg per unit distance (m), undesirable adhesion of the brush head 22 is prevented and a proper application amount can be achieved. To newly supply the liquid cosmetic to the brush head 22, the crown 12 may be pressed along the axial direction, namely, knocked. As a result, the threaded rod 30 is rotated by the rotational force transformed by a knocking mechanical assembly K and the threaded rod 30 is advanced via the threaded body 28 so that a new liquid cosmetic is supplied to the brush head 22.

As described above, according to the embodiment of the present invention, due to a fact that an angle θ formed between a line perpendicular to the axis and a side ridge line of the applying part ranges from 10° to 60°, a circular flange is formed at a rear end of the applying part, a projecting length of the applying part from a tip end of a front barrel ranges from 5 mm to 8 mm, a ratio of a major axis Y and a minor axis X of an opening, being located at the tip end of the front barrel in the applying part, is Y:X=1.3 to 2:1, and when an applied area at a deformation load of 0.01 N and an applied area at a deformation load of 0.1 N both measured from the tip-most portion of the applying part are respectively designated as A and B, A<B<3A is satisfied, application of a liquid cosmetic, more specifically, drawing lines with an eyeliner or an eyebrow and drawing different lines in thickness are made easy.

Further, by mixing more the fibers with a small outer diameter than the fibers with a large outer diameter in the brush head 22, suitable flexibility can be obtained, and occurrence of dregs at the time of recoating and the like can be prevented.

In the embodiment, the cosmetic applicator having the knock type delivery container has been described as an example, but the cosmetic applicator according to the present invention is not limited to the embodiment. For example, the cosmetic applicator according to the present invention can also be applied to a cosmetic applicator in which a brush head is immersed in a liquid cosmetic and application is performed by the brush head, that is, a cosmetic applicator in which a brush head is attached to a tip end of simple rod-shaped body.

Further, an embodiment of the cap of the cosmetic applicator according to the present invention illustrated in FIGS. 7A and 7B are more specifically illustrated in FIGS. 13 to 19. The present invention is not limited to the cap of the cosmetic applicator illustrated in FIGS. 13 to 19.

Figure 13:
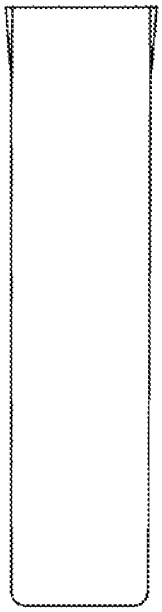
FIG. 13 is a front view of the cap of the cosmetic applicator.
Figure 14:
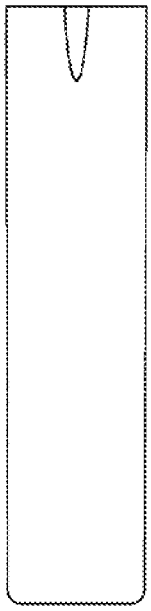
FIG. 14 is a left side view of the cap of the cosmetic applicator.
Figure 15:
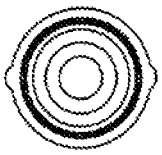
FIG. 15 is a plan view of the cap of the cosmetic applicator.
Figure 16:
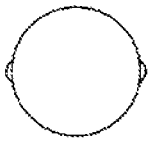
FIG. 16 is a bottom view of the cap of the cosmetic applicator.
Figure 17:
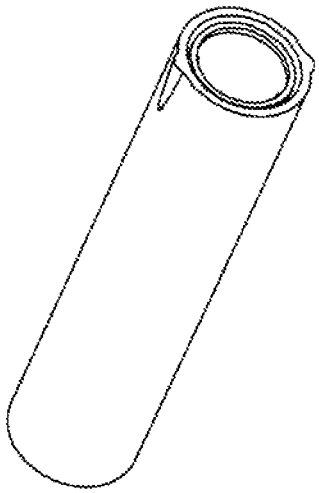
FIG. 17 is a perspective view of a planar side of the cap of the cosmetic applicator.
Figure 18:
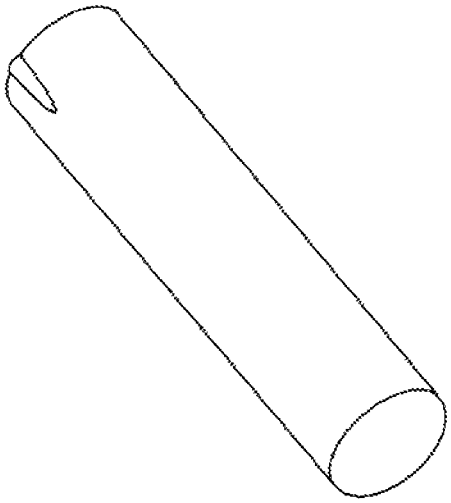
FIG. 18 is a perspective view of a bottom side of the cap of the cosmetic applicator.
Figure 19:
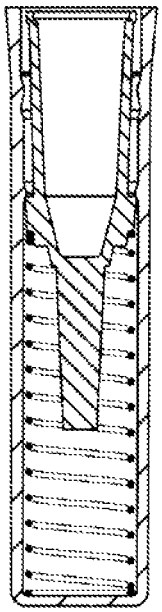
FIG. 19 is a cross-sectional view of the cap of the cosmetic applicator illustrated in FIG. 13.

FIG. 13 is a front view of the cap of the cosmetic applicator. The rear view of the cap of the cosmetic applicator is the same as illustrated in the front view of the cap of the cosmetic applicator. FIG. 14 is a left side view of the cap of the cosmetic applicator. The right side view of the cap of the cosmetic applicator is the same as illustrated in the left side view of the cap of the cosmetic applicator. FIG. 15 is a plan view of the cap of the cosmetic applicator, and FIG. 16 is a bottom view of the cap of the cosmetic applicator. FIG. 17 is a perspective view of a planar side of the cap of the cosmetic applicator, FIG. 18 is a perspective view of a bottom side of the cap of the cosmetic applicator, and FIG. 19 is a cross-sectional view of the cap of the cosmetic applicator illustrated in FIG. 13.

The cosmetic applicator according to the present invention will be further described on the basis of Examples.

<Preparation of Samples>

Figure 10:
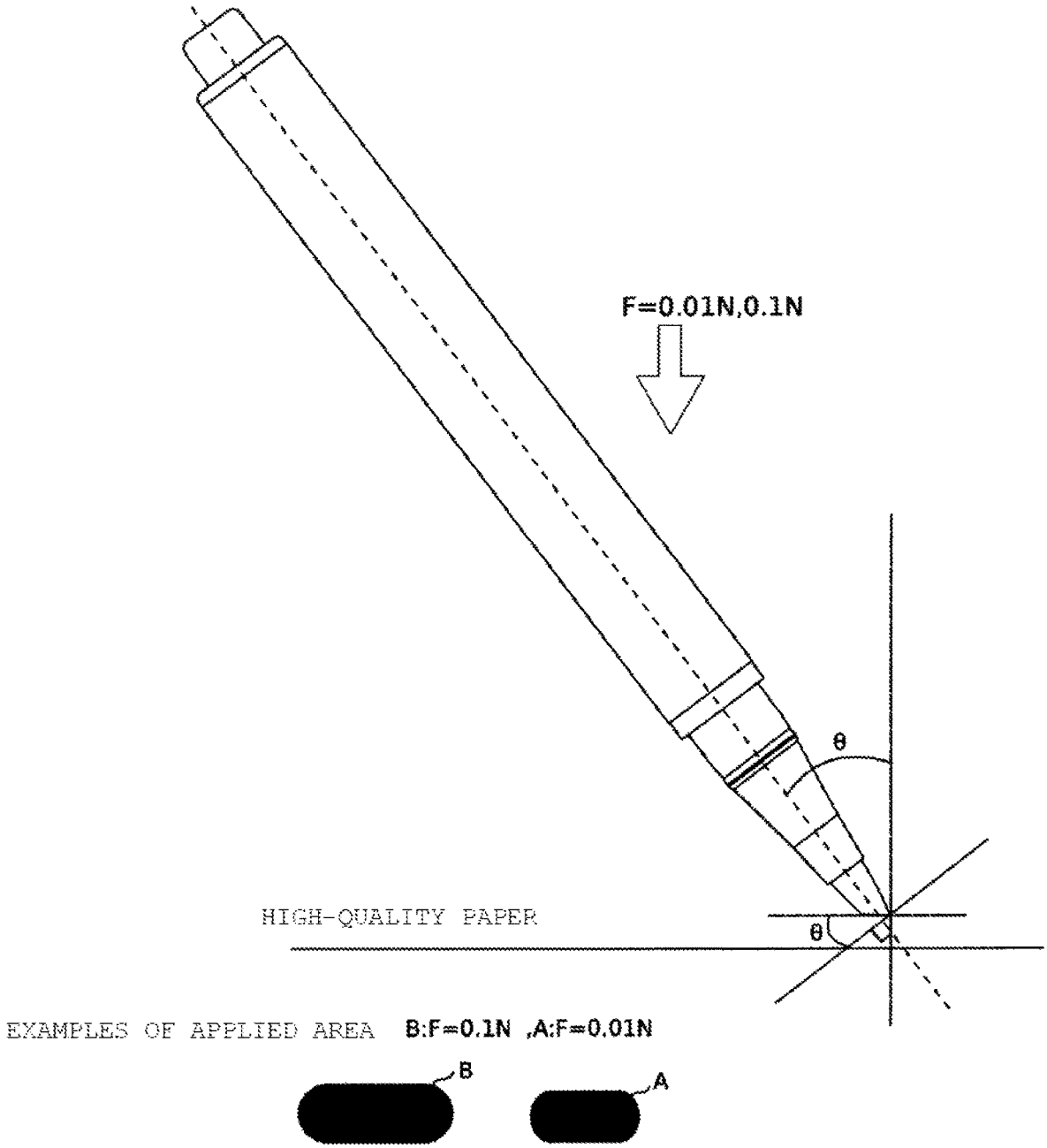
FIG. 10 illustrates an example of an evaluation method representing a deformation amount of an applicator part.

Test samples were prepared on the basis of the contents in Table 1 (Examples 1 to 6) and Table 2 (Comparative Examples 1 to 7). The measurement of the applied areas A and B were performed as follows: as illustrated in FIG. 10, the applicator was fixed obliquely by an angle θ and a sheet of high-quality paper was set on a commercially available load cell for measuring a load. Then, the applicator was separated from the high-quality paper immediately after a load reached 0.01 N at a pressing speed of 1 mm/s, and the area applied on the high-quality paper was defined as A ($mm^2$). Further, the applicator was separated from the high-quality paper immediately after a load reached 0.1 N at a pressing speed of 1 mm/s, and the area applied on another sheet of high-quality paper was defined as B ($mm^2$). The applied areas were measured from the major axis and the minor axis using a calculating formula of ellipse area. The synthetic fibers forming the brush head were made of polybutylene terephthalate.

<Test 1>

The present inventors themselves applied the liquid cosmetic to their own eyes, and verified ease of drawing difference in line thickness. The used liquid cosmetic contains water-soluble dyes (D & C Red No. 33: 1.47 wt %, FD & C Yellow No. 5: 1.67 wt %, FD & C Blue No. 1: 1.06 wt %), pigments (carbon black: 0.13 wt %, Bengal red: 0.83 wt %), dispersants (Beheneth-30: 0.04 wt %, sodium polyaspartate: 0.08 wt %), a coating film forming agent (acrylates copolymer: 8.4 wt %), a thickener (crystalline cellulose preparation: 2.4 wt %), alkane diol (1,3-butylene glycol: 8 wt %, antiseptic agents (paraben: 0.3 wt %, phenoxyethanol: 0.5 wt %, sodium dehydroacetate: 0.25 wt %), and water; and the viscosity at 25° C. is 22 mPa·s.

Meaning of notations of the evaluation results presented in Tables 1 and 2 are as follows:

A: Drawing difference in line thickness was easy.

B: Drawing difference in line thickness was not easy but was possible.

C: Drawing difference in line thickness was difficult.

<Test 2> The present inventors themselves applied and recoated the liquid cosmetic to their own eyes, and verified whether dregs occurred. The used liquid cosmetic was the same as that in Test 1. Meaning of the notations of evaluation results presented in Tables 1 and 2 are as follows:

A: Occurrence of dregs was not recognized.

B: Occurrence of dregs was slightly recognized, but the dregs was less than that in a conventional case.

C: Occurrence of dregs was detected, the situation was the same as in the conventional case.

TABLE 1

| | Example 1 | Example 2 | Example 3 | Example 4 | Example 5 | Example 6 |
|---|---|---|---|---|---|---|
| Angle θ (°) | 30 | 35 | 30 | 30 | 50 | 30 |
| Projecting length L (mm) | 6.5 | 6.5 | 6 | 6.5 | 6.5 | 6.5 |
| Appling part cross-sectional diameter ratio Y/X | 1.3 | 1.75 | 2 | 1.5 | 1.5 | 1.75 |
| Content of fibers with a small diameter of 0.1 mm | 60% | 60% | 60% | 60% | 55% | 60% |
| Content of fibers with a large diameter of 0.15 mm | 40% | 40% | 40% | 40% | 45% | 40% |
| Applied area A ($mm^2$) | 2.1 | 2.3 | 3.8 | 3 | 3 | 3.8 |
| Applied area B ($mm^2$) | 4.3 | 4.4 | 7 | 4.5 | 6.2 | 8 |
| B/A | 2.05 | 1.91 | 1.84 | 1.5 | 2.07 | 2.11 |
| Test 1: Drawing difference in line thickness | A | A | A | A | A | A |
| Test 2: Occurrence of dregs | A | A | A | A | A | A |

TABLE 2

| | Comparative Example 1 | Comparative Example 2 | Comparative Example 3 | Comparative Example 4 | Comparative Example 5 | Comparative Example 6 | Comparative Example 7 |
|---|---|---|---|---|---|---|---|
| Angle θ (°) | 30 | 0 | 30 | 30 | 65 | 40 | 30 |
| Projecting length L (mm) | 9 | 8 | 6.5 | 4.5 | 6.5 | 6.5 | 6.5 |
| Appling part cross-sectional diameter ratio Y/X | 1.5 | 1 | 1.75 | 1.75 | 1.2 | 1.75 | 2.5 |
| Content of fibers with a small diameter of 0.1 mm | 60% | 60% | 0% | 60% | 60% | 100% | 60% |
| Content of fibers with a large diameter of 0.15 mm | 40% | 40% | 100% | 40% | 40% | 0% | 40% |
| Applied area A ($mm^2$) | 3 | 1 | 2 | 2.5 | 4 | 2 | 2.5 |
| Applied area B ($mm^2$) | 7 | 3.5 | 2.4 | 4 | 13 | 6.2 | 4 |
| B/A | 2.33 | 3.50 | 1.20 | 1.60 | 3.25 | 3.10 | 1.60 |
| Test 1: Drawing difference in line thickness | B | C | B | C | B | C | B |
| Test 2: Occurrence of dregs | B | C | C | A | C | B | A |

As shown in Tables 1 and 2, since drawing difference in line thickness was able to be performed and occurrence of dregs was not also detected, the effect of the present invention can be confirmed from the results of Examples 1 to 6.

What is claimed is:

1. A cosmetic applicator, comprising:

an applying part at a tip end of the applicator;

a front barrel, wherein the tip end of the applicator is located on the front barrel; and a containing part containing liquid cosmetic that is to be applied through the applying part, wherein a tip-most portion of the applying part is disposed at a position deviated from an axis of the applying part and an angle θ between a line perpendicular to the axis and a side ridge line of the applying part ranges from 10° to 60°, a circular flange is formed at a rear end of the applying part, a projecting length of the applying part from a tip end of the front barrel ranges from 5 to 8 mm, a ratio of a major axis Y and a minor axis X of an opening, being located at the tip end of the front barrel in the applying part, is Y:X=1.3 to 2:1, and when A and B respectively denote an applied area at deformation load of 0.01 N and an applied area at deformation load of 0.1 N both measured from the tip-most portion of the applying part, A<B<3A is satisfied.

2. The cosmetic applicator according to claim 1, wherein the applying part is formed of a fiber bundle obtained by bundling a plurality of fibers, and a tip end part of each fiber has a curvature.

3. The cosmetic applicator according to claim 1, wherein the applying part is formed of a fiber bundle obtained by bundling a plurality of fibers, and a variation in length in a tip end of each fiber with respect to the side ridge line of the applying part is within a range of 1 mm.

4. The cosmetic applicator according to claim 1, wherein the applying part is formed of a fiber bundle obtained by bundling a plurality of fibers with a small outer diameter and a plurality of fibers with a large outer diameter, and wherein there are more of the fibers with small outer diameter than the fibers with large outer diameter.

5. The cosmetic applicator according to claim 1, wherein a viscosity of the liquid cosmetic is within a range of 1.5 mPas to 70 mPas.

* * * * *